US005704087A

United States Patent [19]

Strub

[11] Patent Number: 5,704,087

[45] Date of Patent: Jan. 6, 1998

[54] DENTAL CARE APPARATUS AND TECHNIQUE

[76] Inventor: Richard Strub, 1218 Candytuft La., West Chester, Pa. 19380

[21] Appl. No.: 530,750

[22] Filed: Sep. 19, 1995

[51] Int. Cl.[6] ..... A46B 9/04

[52] U.S. Cl. ..... 15/105; 15/167.1; 434/263

[58] Field of Search ..... 15/22.1, 105, 167.1; 434/263

[56] References Cited

U.S. PATENT DOCUMENTS

| | | | |
|---|---|---|---|
| 2,926,487 | 3/1960 | Stone . | |
| 4,341,230 | 7/1982 | Siahou . | |
| 4,788,734 | 12/1988 | Bauer . | |
| 4,866,807 | 9/1989 | Kreit et al. . | |
| 4,934,940 | 6/1990 | Savery . | |
| 5,044,037 | 9/1991 | Brown . | |
| 5,133,102 | 7/1992 | Saituma | 15/167.1 |
| 5,184,959 | 2/1993 | Oryhon et al. . | |
| 5,259,086 | 11/1993 | Fong . | |
| 5,438,726 | 8/1995 | Leite | 15/105 |

FOREIGN PATENT DOCUMENTS

| | | | |
|---|---|---|---|
| 2680086 | 2/1993 | France | 15/105 |
| 2918806 | 11/1980 | Germany | 15/167.1 |
| 3935554 | 5/1991 | Germany | 15/105 |
| 2252234 | 8/1992 | United Kingdom | 15/105 |

*Primary Examiner*—David Scherbel
*Assistant Examiner*—Randall Chin
*Attorney, Agent, or Firm*—Famiglio & Massinger

[57] ABSTRACT

A toothbrush is equipped with electronic means for measuring the time interval between a visit to the dentist and the time when the next visit is to take place. The toothbrush remains "dormant" during that time interval. At the end of the interval, electronic means are activated to provide a visual and/or audible alerting signal to the user of the toothbrush. The signal is delivered during actual use of the brush. Preferably, it is repeated, at relatively short intervals, during subsequent uses of the brush.

18 Claims, 5 Drawing Sheets

DENTAL CARE APPARATUS AND TECHNIQUE

BACKGROUND OF THE INVENTION

The invention relates to an apparatus and technique useful in dental care. In particular, it relates to such an apparatus and technique which is useful in causing dental check-ups to take place without undue delay.

The maintenance of dental health is greatly assisted by not permitting excessive periods of time to elapse between visits to the dentist. A period, of, say, six months between such visits is thought to be appropriate to detect developing caries, or other irregularities, before they become serious enough to require major, or even emergency intervention. However, it is notorious that, for one reason or another, patients tend to not observe this desirable regularity. Efforts to overcome this problem have typically taken the form of written reminders, e.g., in the form of a postcard which notifies the patient that it is time for a check-up. Sometimes telephonic reminders have also been used. Results suggest that written reminders are too easy to ignore, while telephone reminders are too fleeting to be effective. In general, known techniques for stimulating such check-ups have had mixed effectiveness, at best.

SUMMARY OF THE INVENTION

Accordingly, it is an object of the invention to provide a technique for stimulating people's awareness of the timeliness of dental check-ups.

It is another object to provide such a technique which is free of one or more deficiencies of the prior art.

It is still another object to provide such a technique which is relatively difficult to ignore.

It is still another object to provide apparatus for practicing the technique.

These and other objects of the invention which will appear are achieved in accordance with the invention as follows.

A toothbrush is provided which is equipped with electronic means for measuring the time interval between a visit to the dentist and the time when the next check-up is to take place. The toothbrush remains "dormant" during that time interval. At the end of the interval, electronic means are activated to provide a visual and/or audible alerting signal to the user of the toothbrush. This signal is delivered during actual use of the brush. Preferably, it is repeated, at relatively short intervals, during subsequent uses of the brush.

In this way, the check-up reminder is delivered automatically and with persistent repetitiousness, thereby making it easier for the user to remember to schedule a visit as desired.

BRIEF DESCRIPTION OF THE DRAWINGS

For further details, reference is made to the description which follows, in light of the accompanying drawings, wherein.

DETAILED DESCRIPTION OF THE PREFERRED EMBODIMENTS

Figure 1:
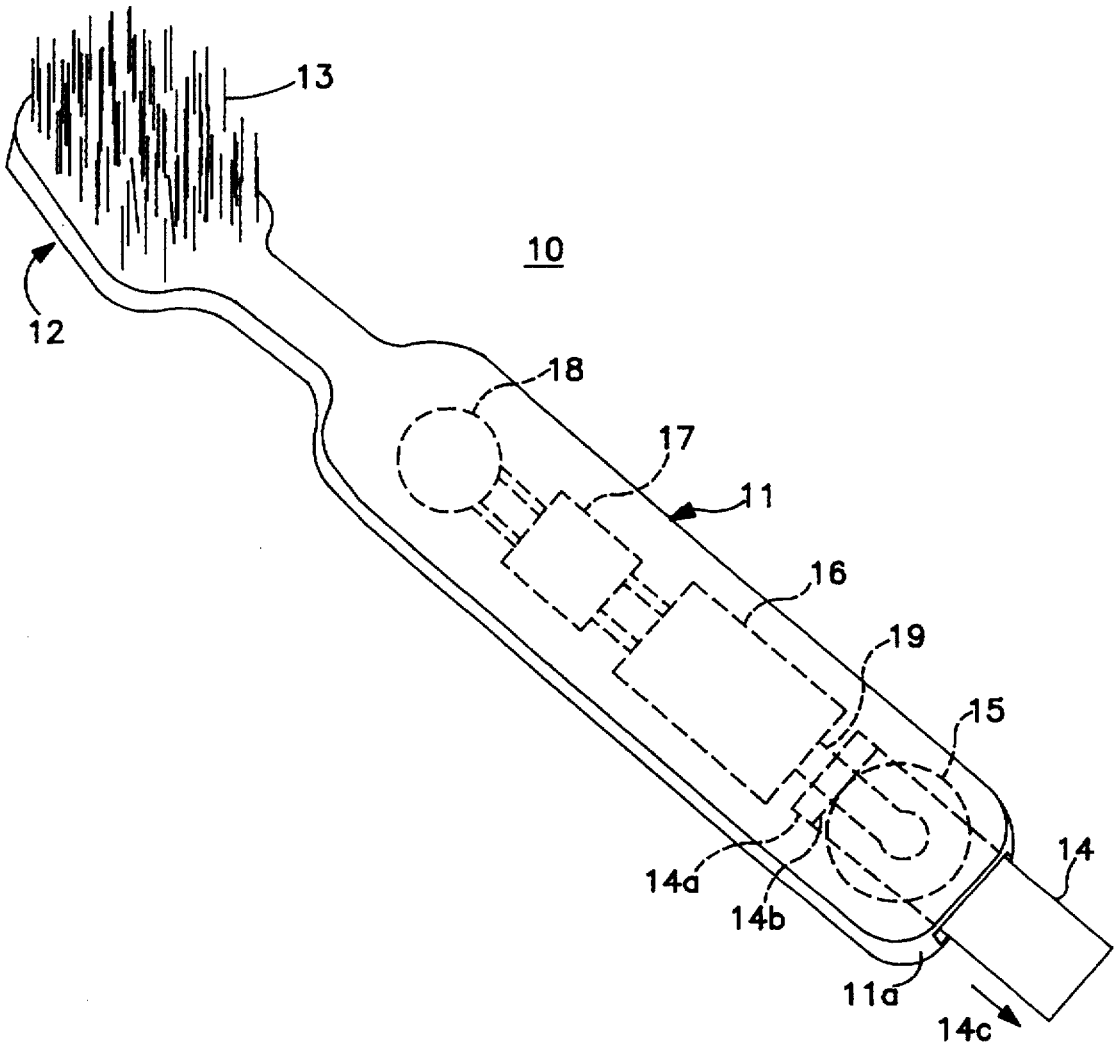
FIG. 1 is an overall diagrammatic representation of a toothbrush embodying the invention.

Referring to FIG. 1, this shows a toothbrush 10 having a handle 11 and a head 12 with bristles 13. From the end face 11*a* of handle 11, there protrudes a pull tab 14. Inside the handle 11 there are housed a number of components which are shown in dashed lines because, to the extent that the handle 11 is not transparent, or at least translucent, those components would not be visible from the outside. These components housed in the handle include a battery 15, an integrated circuit (IC) and related discrete circuit elements collectively represented by rectangle 16, a sensor 17 and an alerting transducer 18. Leads interconnect the various components. The electrical connection between battery 15, which may be in the form of a conventional button cell, and component 16 is provided by parallel flat springs, of which only the upper spring 19 is visible in FIG. 1. These flat springs grip between them the opposite faces of button cell 15, thereby providing contact to the opposite terminals of the cell.

The pull tab 14 extends through a slot in end 11*a* of handle 11 into the interior of the handle and is initially positioned so that it separates contact spring 19 from the adjacent battery terminal. This tab 14 is made of electrically insulating material. Therefore, in the position described above, it insulates spring 19 from the adjacent terminal of battery 15, which is thereby kept electrically disconnected from the remaining components in handle 11.

Pull tab 14 has a thickened portion 14*a* near the end positioned inside the handle, and that thickened portion is further joined to the remainder of the pull tab by a frangible element, such as the perforations represented by broken line 14*b* in FIG. 1, or in the alternative, a narrowed cross-section.

When the pull tab is then pulled in the direction of arrow 14*c* in FIG. 1, it will eventually slide out from between spring 19 and the adjacent terminal of battery 15. The spring will then contact that terminal, and this will complete the electrical connection between the battery and the other components. Thus pull tab 14 operates as a one-time-use switch for connecting battery 15 to the remaining electronics in the handle. When the thickened portion 14*a* seats in the slot in and face 11*a* of the handle, further travel of tab 14 in the direction of arrow 14*c* is inhibited.

Thickened portion 14*a* performs two functions. It functions as a stop which inhibits the further pulling out of pull tab 14 from handle 11. In so doing it facilitates the tearing off of the protruding portion of the pull tab 14 at frangible element 14*b*. Its second function is as a water-tight plug by providing a mating fit within the slot in end 11*a* of the handle 11. Turning to component 16 in FIG. 1, this includes a programmable microprocessor (see discussion of FIG. 3 below) which is programmed so as to provide several functions when energized by battery 15. One of these functions is to measure the elapsed time from such energization. This elapsed time corresponds to the desired time interval between a given dentist visit and the time when the next visit should take place.

Another function is to control an alert signal for providing a reminder that this desired time interval between dentist visits has elapsed. The reminder can be given optionally by means of a flashing light, tone or voice message. Furthermore, these reminders are repeated at a frequency which can be any combination of fixed and variable intervals.

Still another function of the microprocessor within component 16 is to detect a signal from sensor 17 indicating that the toothbrush is in fact in use. It is in response to such a signal from sensor 17 that component 16 controls the alerting reminder described above. By doing so while the toothbrush is in use, it assures that the reminder will be perceived by the user.

Turning to sensor 17 in FIG. 1, this is preferably a pressure sensitive device built into the surface of the handle so that it responds to the pressure which the user's hand exerts while the brush in use in order to provide a signal which causes the component 16 to operate transducer 18. Such pressure sensitive devices are well known and may consist for example of a membrane type switch located in the approximate position of sensor 17 shown in FIG. 1, where experimentation has shown that a toothbrush user's fingers typically exert pressure during use.

An alternative is a capacitive sensor which responds to the presence of the user's hand on handle 11. Sensor 17 can also be in the form of a motion detector which responds to movement of the toothbrush, such as inevitably occurs during its use.

Still referring to FIG. 1, the transducer 18 can take any one of several forms of signalling devices.

Preferably an optical signalling device is used. In its simplest and most economical form, this consists of a light emitting diode (LED) which is activated by component 16 in response to the operation of sensor 17 and which is located within handle 11 so as to be visible to the user of the brush from the bristle side of the toothbrush. Experimentation has shown that a location in the general vicinity of that shown for transducer 18 in FIG. 1 is suitable, namely a location close to the end of handle 11 nearest the head 12. That is because the manner in which users typically hold a toothbrush tends to leave that portion of the handle exposed. Therefore an optical signalling device visible from the bristle side of the toothbrush will tend to be noticed by the user, thereby producing the desired alerting/reminding effect.

Alternatively, an acoustic signalling device may be used as transducer 18. This can take the form of a waterproof miniature microphone, activated to produce an alerting tone, or even a message such as "time to see your dentist". Again the location is preferably in the general vicinity of transducer 18 in FIG. 1, for convenient exposure during use.

Returning to the alternative of a light emitting diode as alerting transducer 18, this is preferably positioned behind a translucent portion of handle 11, so that its light is visible to the user. That translucent portion can also be shaped to convey a more specific reminder message when back-lit by the LED, such as "time for check-up".

The microprocessor which forms part of component 16 can also be programmed to cause the LED to flash when activated in response to sensor 17, or to cause the alerting tone or message to repeat when an acoustic reminder is provided.

Figure 2:
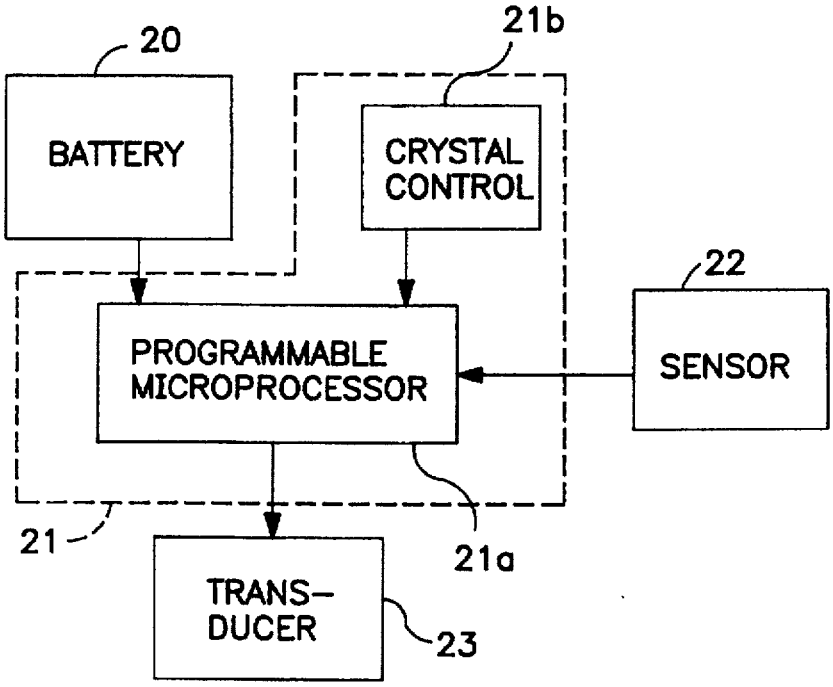
FIG. 2 is a simplified block diagram of the electronic components of the embodiment of FIG. 1.

Referring now to FIG. 2, this shows a simplified block diagram of the invention's electronics. In this diagram, block 20 corresponds to the battery 15 of FIG. 1, block 21 corresponds to component 16 of FIG. 1, block 22 to sensor 17 and block 23 to transducer 18. In this simplified diagram of FIG. 2, component 21 includes a programmable microprocessor **21*a* and a crystal control circuit 21*b***.

The battery (block 20 in FIG. 2) energizes the remainder of the electronics. The microprocessor **21*a* and crystal control circuit 21*b* together determine the time duration of the "dormant" period between such energization of the electronics and the occurrence of the alerting/reminder episodes, which may take place only after a lengthy time lapse of perhaps six months or so. To that end, the crystal control circuit (block 21*b*) provides a conventional timing signal which enables microprocessor 21*a* to determine the end of the dormant period. Once that dormant period has ended, the microprocessor 21*a* becomes enabled to respond to inputs from the sensor (block 22) to activate the alerting transducer (block 23**) and cause it to operate.

Figure 3:
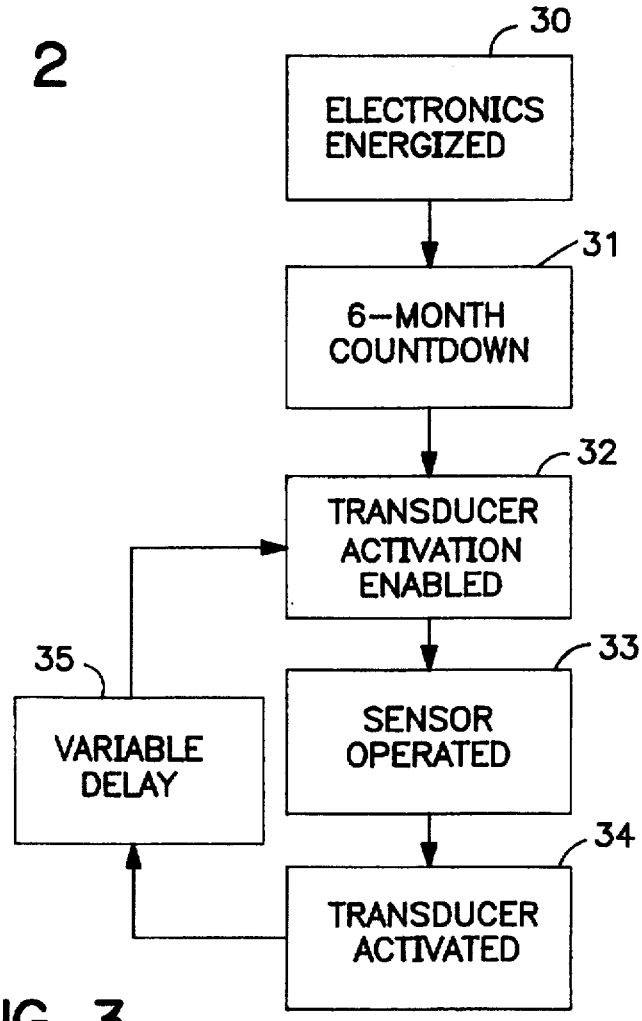
FIG. 3 is a flow diagram of the sequence of operations which take place in the embodiment of FIG. 1.

The various steps which are accomplished by the apparatus of FIGS. 1 and 2 are illustrated in the flow diagram of FIG. 3, to which reference may now be had. The process starts with the energizing of the electronics (represented by block 30 in FIG. 3), e.g. by pulling out of tab 14 (FIG. 1) until it no longer insulates connector 19 from the adjacent terminal of battery 15. This energization starts a countdown (block 31 in FIG. 3) which may last, for example, for six months. During that time, the apparatus is "dormant", in the sense that microprocessor **21*a* (FIG. 2) remains unresponsive to sensor 17. At the end of that period, microprocessor 21*a* switches to a state in which it is responsive to sensor 17 to enable the activation of transducer 23 (block 32 in FIG. 3). When that sensor is operated (block 33 in FIG. 3) by use of the toothbrush, the response is to activate the transducer 18 (FIG. 1) and thereby produce the desired alert as a reminder to the user (block 34 in FIG. 3**).

It will be noted that sensor 17 (FIG. 1) may have been activated many times by repeated toothbrush usage during the six month countdown (block 31 in FIG. 3). However, due to the non-responsive state of microprocessor **21*a* (FIG. 2**) during that period, no alert was produced during that six month time period.

Reverting to FIG. 3, the operation of transducer 18 (FIG. 1) is preferably followed by a time delay (block 35 in FIG. 3) provided by microprocessor **21*a*. This time delay has the purpose of preventing annoyingly frequent activations of transducer 18 during repeated usage of the toothbrush. During this time delay, the microprocessor 21*a* (FIG. 2) again becomes temporarily non-responsive to the operation of sensor 17 and transducer activation is thereby disabled during that delay time. Crystal control circuit 21*b* (FIG. 2) again provides the timing signal which is used by microprocessor 21*a*** in determining this non-responsive delay interval.

The time delay in question may typically be somewhere between four and six days' duration. As a result, use of the toothbrush will result in an alert only once every several days, instead of each time it is used. This not only reduces potential annoyance from too-frequent reminders, but also enhances the conspicuousness of the reminders when they do occur.

Moreover, the length of this delay—and therefore the time interval between consecutive reminders—may be made and preferably is made pseudo-randomly variable within limits such as the four and six days mentioned above.

Figure 4:
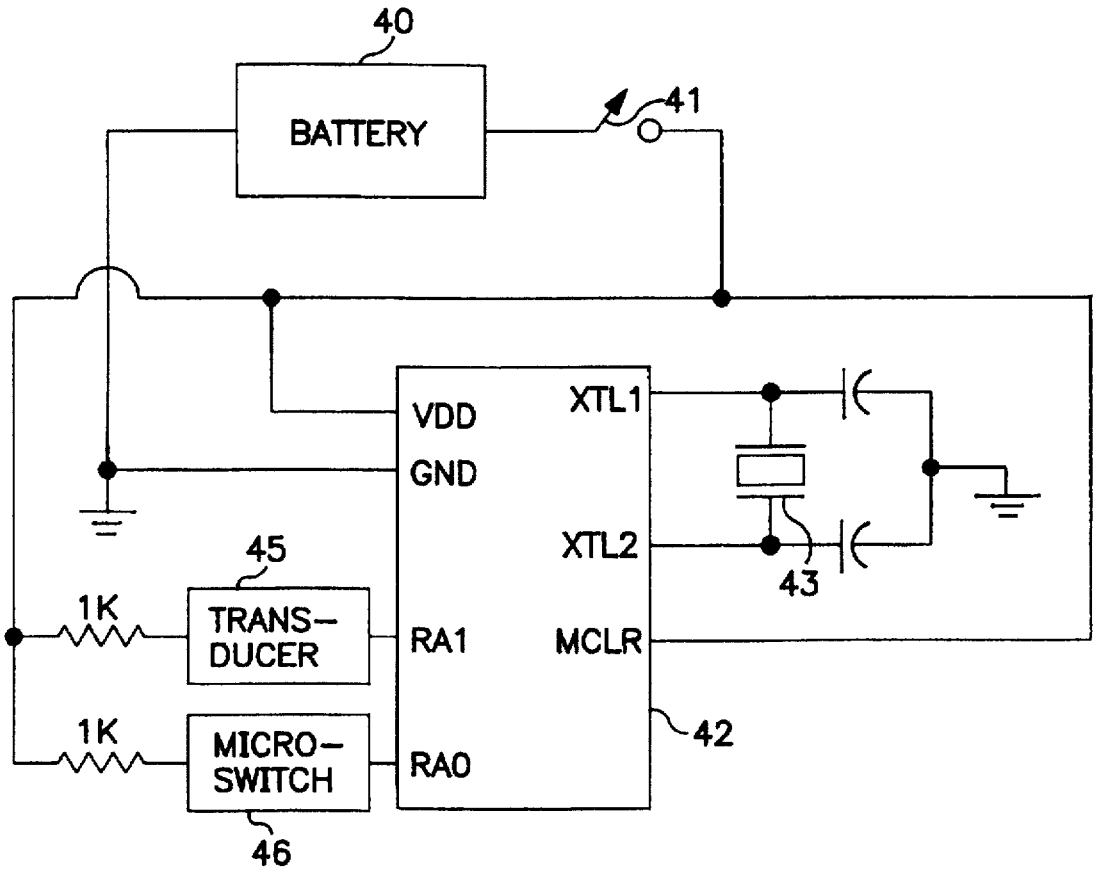
FIG. 4 is a simplified schematic diagram of the electronic circuitry of the invention.

Referring now to FIG. 4, this is a schematic diagram of one form of electronics embodying the invention. In FIG. 4, the battery block 40 corresponds to battery 15 in FIG. 1. Switch 41 in FIG. 4 represents the arrangement in FIG. 1 which includes pull-tab 14. The open state in which switch 41 is shown in FIG. 4 corresponds to the state in FIG. 1 in which pull-tab 14 is interposed between contact spring 19 and the adjacent terminal of battery 15. In this open state, the electronics of the invention are completely de-energized. Therefore, the time interval during which these electronics remain "dormant",—after having been energized,—has not yet started. The alternative, closed state of switch 41 (FIG. 4) would correspond to that state in FIG. 1 in which the pull-tab 14 has been pulled out from between spring 19 and battery 15, thereby energizing the electronics and starting the ensuing "dormant" time interval.

Element 42 in FIG. 4 corresponds to the microprocessor which forms part of component 16 in FIG. 1 (see also block 21*a* in FIG. 2) and crystal 43 is part of the crystal control circuit 21*b* in FIG. 2.

The remaining elements are as shown in the drawing, with the various connections to the microprocessor being made at the named pins of microprocessor 42.

The battery 40 is a 3 volt lithium battery, the crystal 43 is a conventional 32 kHz crystal, the microprocessor 42 is model PIC16C54, available from Microchip, Inc. of Tempe, Ariz., the conventional LED 45 corresponds to the alerting transducer 18 of FIG. 1 and the microswitch 46 is the pressure-activated sensor 17 of FIG. 1.

As previously discussed, the microprocessor is programmed so that, after switch 41 is closed, a predetermined time interval has to elapse before the operation of switch 46 through use of the toothbrush will cause LED 45 to illuminate. The programming also includes the pseudo-random delay imposed before repeat reminders can be given.

Figure 5:
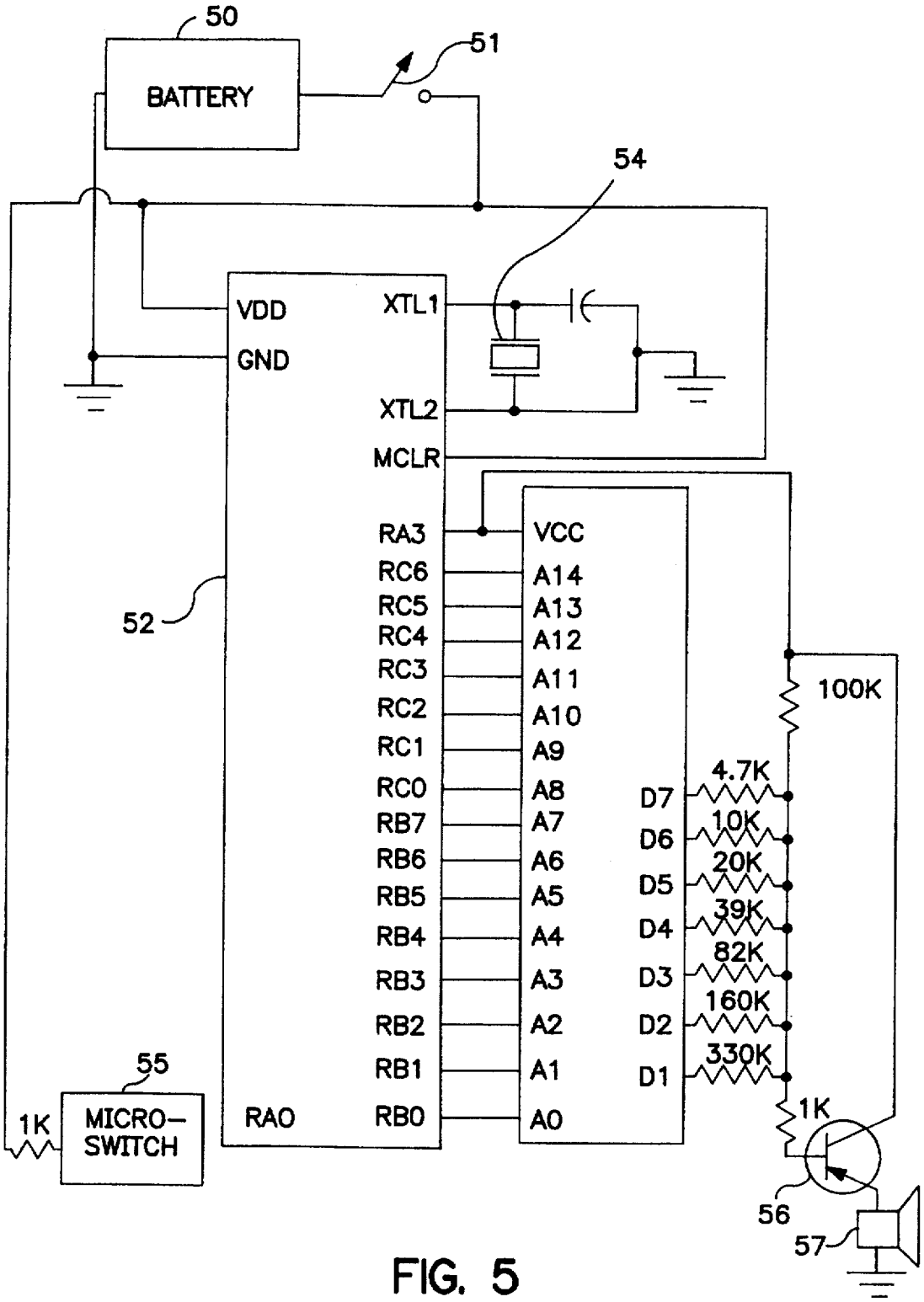
FIG. 5 is a simplified schematic diagram of another embodiment of the electronic circuitry.

Referring now to FIG. 5, this is a schematic diagram of electronics embodying an alternative embodiment of the invention. In FIG. 5, the battery block 50 corresponds again to battery 15 in FIG. 1 and switch 51 in FIG. 5 represents the arrangement in FIG. 1 which includes pull-tab 14. In the open state of switch 51 shown in FIG. 5, the pull-tab 14 in FIG. 1 is between spring 19 and the adjacent terminal of battery 15, leaving the electronics of FIG. 5 completely de-energized. As a result, the time interval during which these electronics remain "dormant"—even after having been energized,—has not yet started. In its alternative, closed state, switch 51 would correspond to the state in FIG. 1 in which the pull-tab 14 has been pulled out from between spring 19 and battery 15, thereby energizing the electronics and starting the ensuing "dormant" time interval for the electronics of FIG. 5.

Element 52 in FIG. 4 and element 53 in FIG. 4 correspond, respectively, to the microprocessor which forms part of component 16 in FIG. 1 and an EPROM which, in this embodiment, also forms part of component 16. Likewise, crystal 54 in FIG. 5 is part of the crystal control circuit of component 16.

In addition, FIG. 5 includes a microswitch 55, a transistor 56 and a loudspeaker 57.

The remaining elements of FIG. 5 are as shown in the drawing, with the various connections to the microprocessor 52 and EPROM 53 being made at the named pins of these two elements.

As in the case of FIG. 4, the battery 50 is a 3 volt lithium battery, the crystal 54 is a conventional 32 kHz crystal. In this case, the microprocessor is model PIC16C55 and the EPROM is model 27C128, both available from Microchip, Inc. of Tempe, Ariz. The microswitch 55 is the pressure-activated sensor 17 of FIG. 1, the transistor 56 is a conventional type 2N3904 and the speaker 57 is a conventional miniature waterproof loudspeaker.

As previously discussed, the microprocessor 52 is programmed so that, after switch 51 is closed, a predetermined time interval must elapse before operation of switch 55 through use of the toothbrush will cause speaker 57 to be activated. This programming also includes the pseudo-random delay imposed before repeat reminders can be given. The EPROM 53 is programmed with the message to be delivered by speaker 57. With an EPROM of the model number shown, this message can be of as much as 20 seconds duration.

The invention contemplates having dentist office personnel issue a toothbrush embodying the invention to a patient on the occasion of an office visit. At that time, the toothbrush electronics are also energized, as by pulling out pull tab 14 (FIG. 1) and tearing off the exposed end. The patient is also instructed to use that toothbrush and to schedule a return visit to the dentist when reminded to do so by the alerting function described above. At this return visit, a new toothbrush is issued to the patient and the cycle repeated in this manner.

If appropriate, toothbrushes can be provided which have different "dormant" periods, so as to correspond to different desired intervals between consecutive dentist visits.

Technologically, all that this requires is appropriate programming of the microprocessor 21*a* (FIG. 2) and this would preferably be done during toothbrush manufacture. Thus there may be made available a gamut of toothbrushes, with dormant periods ranging from a low of, say, three months to six or even nine months.

Still other timing relationships will occur to those skilled in the art without departing from the inventive concept. For example, the repetition of reminders following the "dormant" period may be made according to a predetermined schedule, with more frequent repetitions as time passes. Thus, during the first two weeks, the repetitions may occur 4–6 uses apart, then 3 uses apart during the next two weeks, and finally at every other use during the third two weeks. Of course, during all these intervals, the crystal-controlled timing function continues to operate as appropriate.

As for the individual electronic components which make up the inventive apparatus, these are all entirely conventional and may take any one of many conventional forms. Other variations may also occur to those skilled in the art without departing from the inventive concept.

Figure 6:
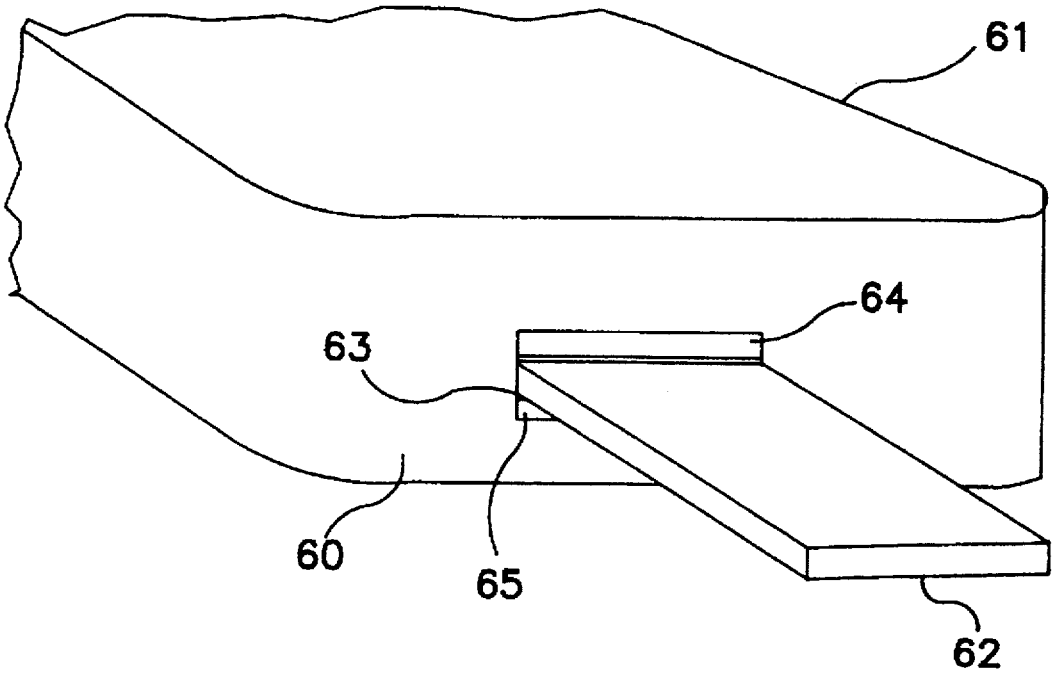
FIG. 6 is an enlarged fragmentary view of another embodiment of the invention.

For example, referring to FIG. 6, this shows an end view in perspective, of the free end 60 of a toothbrush handle 61. A pull tab 62 extends out of a slot 63 in handle end 60. Although not visible in FIG. 6, this pull tab 62 extends inwardly in the handle and is located inside the handle between a battery corresponding to battery 15 of FIG. 1 and a connecting spring corresponding to spring 19 in FIG. 1. Being of insulating material, the pull tab 62 thus initially prevents the circuitry inside the handle from being energized.

Unlike strip 14 in FIG. 1, this pull tab 62 in FIG. 6, has no thickened portion (such as portion 14*a* in FIG. 1) and no frangible element (such as element 14*b* in FIG. 1).

Rather, the pull tab 62 in FIG. 6 is of uniform configuration throughout. In the embodiment of FIG. 6, the electrical connection between spring and battery, which determines the start of the "dormant" period of the electronics, is established by pulling tab 62 completely out of the handle through slot 63. Sealing of this slot 63 upon removal of the pull tab 62 is accomplished by providing this slot with resilient edges or "lips" 64, 65. These lips close against each other after tab 62 has been pulled out, and thereby seal the slot 63.

In view of the foregoing, it is desired that the scope of the invention be limited only by the appended claims.

What is claimed is:

1. A toothbrush for automatically reminding a user of the time for a visit to the dentist, comprising:

electronic circuit means housed inside the toothbrush for producing a visual or audible signal, said circuit means including a battery for energizing the circuit means, an electro-optical or electro-acoustic transducer, a microprocessor including means for preventing said transducer from being activated during a predetermined time interval following said energizing and for enabling said transducer to be activated after said predetermined interval, means responsive to use of the toothbrush by the user to cause the microprocessor to activate said transducer;

and means for initially preventing said battery from energizing said circuit means and operable to cause said battery to energize the circuit means.

2. The toothbrush of claim 1 further comprising means for preventing said transducer from being activated even after said predetermined time interval during each of a plurality of pseudo-randomly spaced intervals.

3. The toothbrush of claim I wherein said predetermined interval corresponds to the time interval between one dentist visit and the next scheduled dentist visit.

4. The toothbrush of claim 1 wherein said means responsive to use of the toothbrush is a sensor which operates in response to hand pressure during use.

5. The toothbrush of claim 4 wherein the sensor is a microswitch mounted in the handle of the brush.

6. The toothbrush of claim 1 wherein said means responsive to use of the toothbrush is a sensor which operates in response to movement of the brush during use.

7. The toothbrush of claim 1 wherein said means responsive to use of the toothbrush is a sensor which operates in response to contact with the user's hand to the toothbrush.

8. The transducer of claim 1 wherein the electro-optical transducer is a light emitting diode mounted behind a translucent portion of the toothbrush handle near the head of the brush.

9. The toothbrush of claim 8 wherein the microprocessor is programmed to cause flashing of the light emitting diode when activated by the microprocessor.

10. The toothbrush of claim 8 wherein the translucent portion is in the form of a readable message.

11. The toothbrush of claim 1 wherein the electro-acoustic transducer is a waterproof miniature loudspeaker mounted in a portion of the toothbrush handle near the head of the brush.

12. The toothbrush of claim 11 wherein the microprocessor is programmed to cause a tone to be emitted by the loudspeaker when activated by the microprocessor.

13. The toothbrush of claim 12 wherein the tone is in the form of an audible message.

14. The toothbrush of claim 1 wherein the means for initially preventing the battery from energizing the circuit means is an insulating strip located between a terminal of the battery and a connecting lead for said battery.

15. The toothbrush of claim 14 wherein the insulating strip has a portion which projects outside the handle of the brush by means of which the strip can be pulled out from between said battery terminal and connecting lead.

16. The toothbrush of claim 15 wherein the insulating strip has a thickened portion at its end inside the brush, the thickened portion serving as a stop in pulling said strip outwardly and also serves to seal an opening in the handle through which the strip projects.

17. The toothbrush of claim 16 wherein the strip has a frangible region at which the projecting portion can be severed from the remainder of the strip.

18. The toothbrush of claim 15 wherein an opening in the handle through which the strip projects has resilient edges which serve to seal said opening after the strip has been pulled out through said opening.

* * * * *